United States Patent [19]

Wolf

[11] 4,359,858

[45] Nov. 23, 1982

[54] METHOD OF AND APPARATUS FOR WINDING A FILAMENT ONTO A BOBBIN

[75] Inventor: Horst Wolf, Albershausen, Fed. Rep. of Germany

[73] Assignee: Zinser Textilmaschinen GmbH, Ebersbach, Fed. Rep. of Germany

[21] Appl. No.: 164,530

[22] Filed: Jul. 2, 1980

[30] Foreign Application Priority Data

Jul. 7, 1979 [DE] Fed. Rep. of Germany ..... 2927616

[51] Int. Cl.[3] ..... D01H 13/24; D01H 1/20; D01H 1/24; D01H 1/30

[52] U.S. Cl. ..... 57/93; 57/78; 57/98; 242/26.1

[58] Field of Search ..... 57/92, 94, 95, 98, 78, 57/79, 88, 93, 96; 242/26.1, 26.4

[56] References Cited

U.S. PATENT DOCUMENTS

| | | | |
|---|---|---|---|
| 1,614,718 | 1/1927 | Colmon et al. | 242/26.1 |
| 3,134,217 | 5/1964 | Williamson | 57/79 |
| 3,372,882 | 3/1968 | Graf | 242/26.1 |
| 3,422,614 | 1/1969 | Dürler et al. | 242/26.1 X |
| 3,462,935 | 8/1969 | Brower | 242/26.4 X |
| 3,521,441 | 7/1970 | Lamparter | 57/93 |
| 3,526,244 | 9/1970 | Joy | 57/93 X |
| 3,638,414 | 2/1972 | Williams | 242/26.1 X |
| 3,803,824 | 4/1974 | Williamson et al. | 242/26.4 X |
| 4,023,342 | 5/1977 | Schenkel | 57/93 X |

FOREIGN PATENT DOCUMENTS

| | | | |
|---|---|---|---|
| 1123960 | 11/1959 | Fed. Rep. of Germany | 242/26.1 |
| 1417640 | 10/1965 | France | 242/26.1 |
| 1200218 | 7/1970 | United Kingdom | 242/26.1 |

*Primary Examiner*—Donald Watkins

[57] ABSTRACT

A yarn-body core is supported by an upright spindle adjacent a vertically displaceable yarn guide through which a yarn to be wound passes to the core. The core and spindle are rotated and simultaneously the guide is displaced upwardly along the core to wind the yarn on the core until an instant when a yarn package having a predetermined size is formed on the core. Thereafter the guide is lowered to a level below the core while the spindle continues to rotate to wind several turns of the yarn on the spindle below the core. The rotation rate of the spindle and the core is decreased to a relatively low level prior to the instant when the yarn package is completely formed and thereafter this rotation rate is decreased to a standstill in accordance with a predetermined program starting at the instant the yarn package is fully formed and ending when several turns have been wounded on the spindle.

13 Claims, 2 Drawing Figures

METHOD OF AND APPARATUS FOR WINDING A FILAMENT ONTO A BOBBIN

FIELD OF THE INVENTION

The present invention relates to a method of and apparatus for winding a filament up onto a bobbin. More particularly this invention concerns an automatic multiple yarn spinning or twisting machine.

BACKGROUND OF THE INVENTION

In a spinning or twisting apparatus wherein a filament such as one or two yarns is wound up on a core in an automatic machine it is standard practice to feed each filament through a respective guide or traveler to the yarn core. This traveler can orbit about the respective core and can be moved axially along the core by an appropriate support structure. In order to prevent the turns of the filament from becoming enmeshed with each other it is standard practice to reciprocate the support for the travelers so that the turns are spaced from parallel turns and only overlie turns which they cross.

In an automatic machine a multiplicity of such travelers are jointly displaced along the respective cores so as simultaneously to form a multiplicity of bobbins or yarn packages. To maximize production it is obviously necessary to wind the yarn as fast as possible, yet nonetheless to avoid such a high speed that the yarn breaks. Practice has shown that in the middle region of the yarn package or bobbin being formed the speed can be at a maximum whereas in the end region it must be reduced somewhat to avoid breakage. These speeds are determined by the type of yarn, its fineness, and various other factors.

At the end of each winding operation the guide for the travelers through which the respective yarns passes is dropped down to a level below the core being wound so as to wind several turns of the yarn around the spindle carrying the core. Thereafter the core can be removed from the spindle with the yarn breaking between the core and the turns wound around it. In this manner the yarn is held firmly in place at the bottom of the spindle for the next winding operation.

A separate motor is normally responsible for dropping the traveler support down below the yarn core. Normally this is done at a relatively fast rate of speed, relative to the rotation rate for the yarn package, so that the last several turns are rather steeply wound around the exterior of the package. During this operation the main motor continues to operate, but once several turns have been wound around the bottom of the spindle a brake stops the yarn package from rotating.

Various factors must be taken into account at the end of the cycle to prevent too many or too few turns of the yarns from being wound around the respective spindles. The speed of the last stroke of the traveler support along the yarn body as well as the time at which the main motor is shut off, when the brake for the yarn is applied and the braking force must all be taken into account. Normally the rotation rate for the secondary motor, the time at which the main motor is shut off and the brake is turned on, and the braking force vary independently of each other.

The problem with this system is that its takes a relatively experienced operator to set the machine up to operate properly for a given yarn. Any mistakes in the setting can result in ruining the yarn packages and considerable down time for the winding machine.

OBJECTS OF THE INVENTION

It is therefore an object of the present invention to provide an improved method of and apparatus for winding a filament up into a yarn package.

Another object is to provide such an arrangement which eliminates the difficult adjustments described immediately above.

Yet another object is to provide an apparatus wherein the amount of readjustment for different types of yarn is substantially reduced.

SUMMARY OF THE INVENTION

These objects are attained according to the instant invention in a yarn-winding system of the above-described type wherein a yarn-body core is supported on an upright spindle adjacent a vertically displaceable yarn guide through which yarn passes to the core. The core and spindle are rotated and simultaneously the guide is displaced upwardly along the core to wind the yarn on the core until an instant when a yarn package having a predetermined size is formed on this core. After this instant the guide is lowered to a level below the core while the spindle continues to rotate so as to wind several turns of the yarn on the spindle below the core. According to the instant invention the rotation rate of the spindle and core is decreased to a relatively low level prior to the instant at which the guide is lowered and the rotation rate is regularly decreased to a standstill in accordance with a predetermined program starting at this instant and ending when the several turns have been wound on the spindle.

According to the instant invention it is therefore possible to preprogram the entire end part of the winding cycle so that, regardless of the yarn type or size, the machine will automatically wind several turns of the yarn about the spindle below the core so that the core can be withdrawn from the spindle, breaking the yarn between the package formed on the core and the several turns wound on the spindle, thereby leaving the yarn attached to the spindle for a subsequent winding operation. This system can be easily incorporated into any standard spinning or twisting machine, and is best incorporated in a machine wherein a plurality of yarn packages are simultaneously formed, with all of the spindles being rotated jointly and all of the yarn guides being vertically displaced jointly.

According to further features of this invention the yarn guide is reciprocated vertically through strokes substantially shorter than the vertical height of the package during its upward displacement and the rotation rate is decreased to the above-mentioned relatively low level during the last single reciprocation prior to the instant when the yarn package is fully formed and this guide is lowered to below the core. Under normal operating circumstances the rotation rate of the spindle, which is directly proportional to the feed rate of the yarn with the radius being the factor of proportionality between the angular rotation rate and the peripheral speed, is normally varied between a relatively high rate at the center of the yarn package, an intermediate rate at the end regions of the package, and the relatively low rate according to the instant invention. Thus depending on the yarn type, size, and so on the user adjusts these high and intermediate speeds. The low speed at the end of the cycle is already set at the factory so that all these adjustments need not be made, while ensuring a perfect winding of the necessary several turns on the lower end of the spindle.

According to another feature of this invention the number of turns wound around the spindle below the core is between 2.5 and 3.5. This number remains the same for any yarn type, and ensures enough turns will be wound around it so that the yarn will break between these turns and the package on the core, while at the same time the base of the spindle will not be burdened with excess yarn that not only creates a cleaning problem, but wastes yarn. Since spinning and twisting machines are normally set up so that they can operate on various kinds of filaments, but are normally also only adapted to take only one size of spool or core, the instant invention ensures proper finishing of each yarn package with the end of the yarn wound from the top in a rather steep helix around the outside of the package and terminating at a free end below the lower edge of the package. Thus loading of such a yarn package into a creel and threading the yarn through the necessary structure is extremely easy.

The relatively low rate used for the last reciprocation of the yarn guide and from which the speed is decreased to a standstill can easily be determined as the maximum speed usable with the weakest possible filament for which the spinning or twisting machine is intended to be used. The speed should be so low that thread breakage is completely eliminated, but should still be high enough to maintain the balloon about the yarn package. The relatively low speed is normally between 1/5 and ½ of the maximum speed used for winding at the center of the yarn body, and normally is equal to a filament feed rate or between 6 m/min and 10 m/min, normally 8 m/min. The rotation rate is decreased from a relatively low rate normally linearly to a standstill.

According to this invention the spinning or twisting apparatus is provided with switches that are responsive to the axial position of the yarn guide along the spindle. These switches can be electronic or can even be of the hydraulic type depending on the type of drive motors used for the apparatus.

Normally according to this invention a primary drive motor is provided for rotating the spindle and displacing the guide during most of the cycle, and a secondary drive motor is employed only at the beginning and end of the cycle to move the guide through the positions necessary for forming a proper yarn package. The outputs of these two drive motors can be summed in a differential transmission.

The basic principle of the instant invention can, of course, be applied to other types of yarn-winding systems. It is possible to use a separate electric drive for each spindle of a multiple-spindle system, and even to use a separate drive for each guide of an arrangement using a yarn guide different from the standard traveler ring.

SPECIFIC DESCRIPTION

Figure 1:
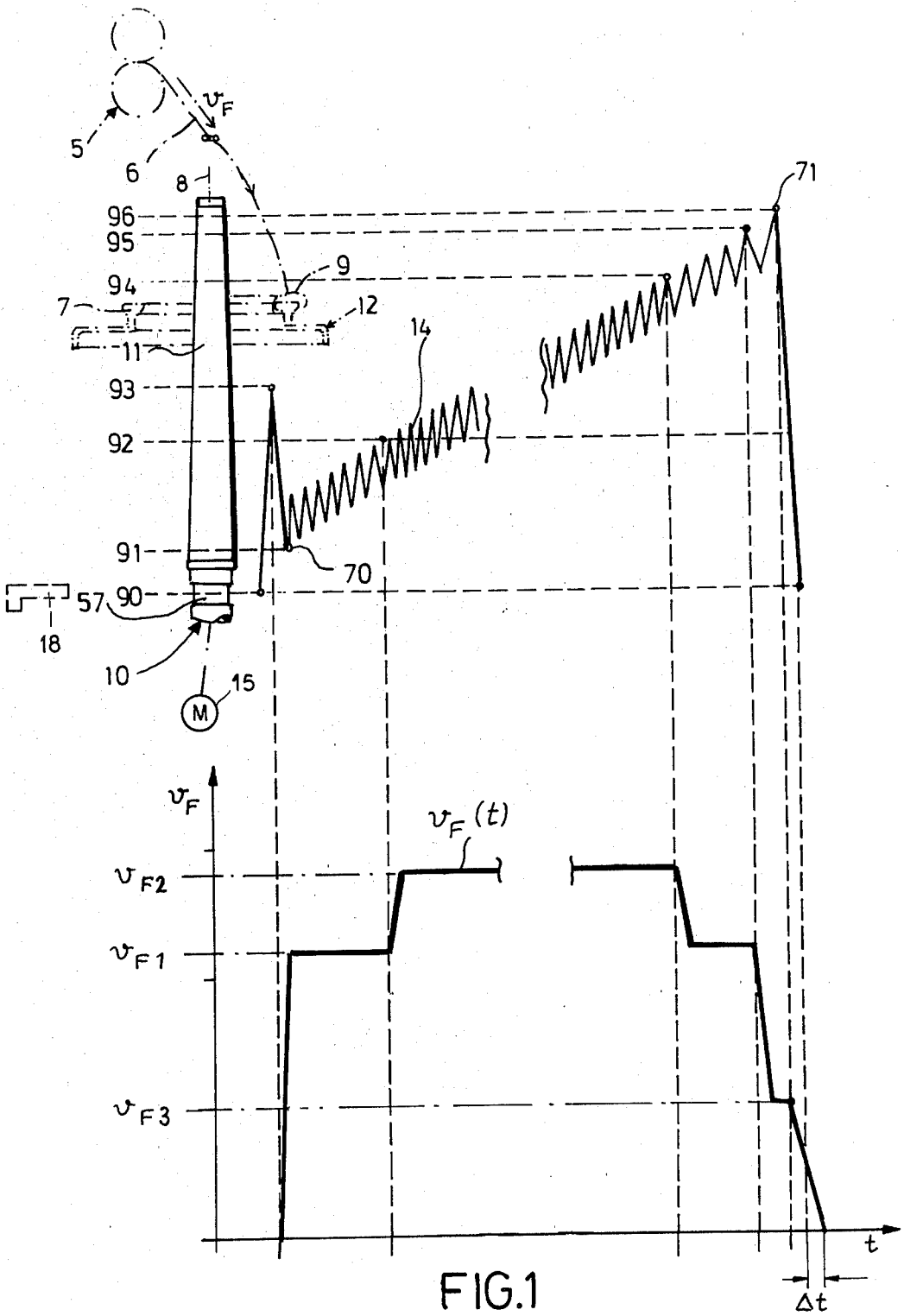
FIG. 1 is a diagram illustrating the method according to the instant invention.
Figure 2:
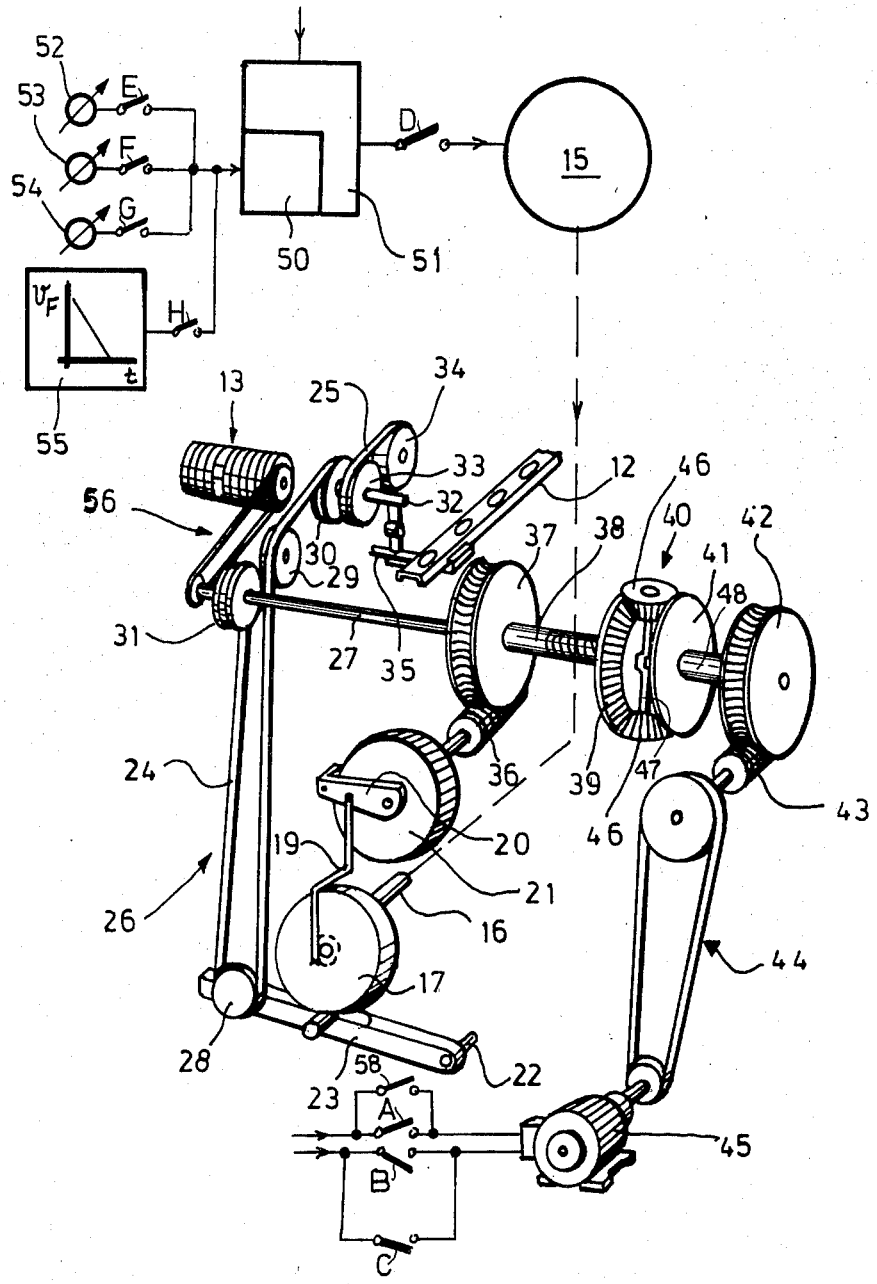
FIG. 2 is a partly schematic view of the apparatus according to this invention.

As seen in FIGS. 1 and 2 at least one yarn or filament 6 is fed by means of a pair of rollers 5 to a traveler 9 carried on a ring 7 mounted with a plurality of other such rings 7 on a vertically displaceable support 12. Each ring 7 surrounds a spindle 10 carrying a standard core 11 and driven for rotation about a vertical axis 8 by means of a variable-speed motor 15. The feed speed $v_F$ for the filament 6 is determined by the rotation speed of the shaft 10. This speed varies as shown on the bottom half of FIG. 1 both with respect to time t and to the position along the axis 9 of the spindle 10. The lower region 57 of the spindle 10 carries the end of the yarn 6, and the core 11 is subdivided between a level 90 at the center of this region 57 and a point 96 at its uppermost end into a plurality of regions, namely a lower end region between points 91 and 92, an upper end region between points 94 and 95, and an intermediate region between the points 92 and 94. The point or level 91 at the bottom of the lower end region is above the level 90 and the upper end 95 of the upper end region is below the uppermost point 96. To start with, as described below, the yarn 6 is first wound up to a point 93 within the central region and then is dropped back down to the point 91, whereas at the end the yarn is wound up one turn to the level 96 and then is dropped back down to the level 90.

This action is carried out by the arrangement shown in FIG. 2. The motor 15 is coupled directly or via a transmission to a shaft 16 carrying an eccentric disk 17 connected via a crank 19 to an eccentric pawl 20 that ratchets with the peripheral teeth of a wheel 21. In addition the eccentric periphery of the disk 17 is engaged by a cam-following lever 23 pivoted at 22 and carrying a roller 28 over which is engaged one belt 24 of a double-belt drive system 26.

A shaft 27 carries a wheel 31 to which one end of the belt 24 is connected, this belt passing over the roller 28 on the lever 23 and then over a deflecting roller 29 to where it is attached to the periphery of another wheel 30 carried on a shaft 32. A second belt 25 of the system 26 is connected to a wheel 33 fixed on the shaft 32 for joint rotation with the wheel 30 and the other end of this belt 25 passes over a deflecting roller 34 and is connected to an attachment 35 on which the support 12 for the rings 7 is carried.

The shaft 27 acts as a pivot axis for a tube 38 carrying at one end a gear 37 meshing with a worm 36 driven by the ratchet gear 21 and carrying at its other end one side gear 39 of a differential-type summing transmission 40. This transmission 40 has a spider 47 carrying a pair of pinions 46 and fixed on the shaft 27. The other side gear 41 of this transmission 40 is connected via another tube shaft 48 to a gear 42 in mesh with a worm 43 that is driven by a motor 45 through a belt drive 44. This motor 45 is of the reversible type and is controllable by switches A, B and C, controllable in turn by means of cams 13 that are driven through a belt drive 56 from the shaft 27.

Assuming that the one side gear 41 does not move, the system described above will, with constant-speed rotation of the shaft 16, vertically reciprocate the support 12 while stepping it upwardly with each reciprocation as indicated at 14 between levels 91 and 94 in FIG. 1. Rotation of the shaft 16 will be effective on the lever 23 to oscillate it about its pivot 22 and thereby raise and lower the support 12 by means of the belt system 26. At the same time rotation of the eccentric disk 17 will be effective through the crank 19 and ratchet pawl 20 on the wheel 21 to rotate the gear 37 and, since the gear 41 is fixed, this shaft 27 will wind up the belt 24 and move the support 12 upwardly in steps.

The motor 45 can, however, superimpose on this motion other movements in either direction by driving the gear 42 to rotate the side gear 41 of the transmission 40 and thereby add or subtract a motion component to that imparted to the shaft 27 by the side gear.

The motor 15, which according to this invention is of the asynchronous squirrel-cage type like the motor 45, is powered via a switch D from a frequency generator 51 incorporating a converter 50 that translates voltage levels received via switches E, F, G and H from respective set-joint generators 52–55. The generators 52, 53 and 54 are manually settable and generate fixed respective voltages, whereas the generator 55 is programmed at the factory and generates a voltage which decreases normally linearly with time. The reversible synchronous squirrel cage motor 45 can be powered in a forward direction by means of a switch A and in a reverse direction by switches B and C. These switches A–H are closed and opened by means of respective cams of a pack 13 driven by the belt drive 56 from the shaft 27. Parallel to the switch A is a momentary-contact on-off switch 58.

The motor 15 also drives the spindle 10 which determines the feed speed $v_F$ so that the axial movements of the carrier or support 12 are made at rates which are proportional to the feed rate $v_F$.

At the start of a winding-spinning operation the support 12 is at level 90, in the middle of the region 57 and all of the switches A–H are open. Either the switch A or the switch 58 in parallel therewith is closed to start the machine operating. This energizes motor 45 to rotate in the forward direction so that it is effective via the transmission 40 directly on the shaft 27 to wind up the belt 24 and thereby move the support 12 from the level 90 to the level 93, whereupon the respective cam opens the switch A and closes the switch B to reverse the motor 45. This movement merely lays the filament 6 axially along the core 93. Simultaneously as the level 93 is reached the switches D and E are closed so as to start up the motor 15 and operate it to wind up the yarn of filament 6 at a rate $v_{F1}$. The filament 6 is thereby wound up on the core 11 as the support 12 moves downwardly from position 93 to position 91, as the relatively rapid rotation rate of the motor 45 summed in the transmission 40 with that of the motor 15 is effective to drop the support 12 rapidly.

On reaching point 70 at level 91 the switch B is, however, opened so that the motor 15 takes over. The feed rate $v_{F1}$, which is established normally as a voltage at the outset by a potentiometer constituting the set-point generator 52, is established in accordance with the type of filament being spun. This rate $v_{F1}$ is substantially below the maximum speed of the motor 15 since breakage is more likely in the end regions, between 91 and 92 and between 94 and 95, than in the middle region between 92 and 94.

Between the levels 91 and 92 the motor thereby reciprocates the support 12 vertically while stepping it slightly upwardly with each reciprocation as indicated schematically in FIG. 1, all at the relatively low speed $v_{F1}$.

When the level 92 is reached the switch E is opened and the switch F is closed, thereby operating the motor 15 with the set point from the generator 53 at its maximum rate of speed $v_{F2}$. Experience has shown that in this middle region between level 92 and 94 the likelihood of filament breakage is extremely low so that the system can be operated at maximum speed for most efficient production. This speed $v_{F2}$ is set by the user in accordance with the type of yarn.

When the level 94 is reached the switch F is opened and the switch E is again closed by the respective cams of the pack 13 to wind the yarn 6 in the end zone between level 94 and 95 at this lower rate $v_{F1}$.

When the support 12 reaches the relatively high level 95 the switch E is again opened and the switch G is closed to operate the motor 15 via the controller 51 from the set-point generator 54 at a yet lower rate $V_{F3}$. This speed is very low, normally between 6 and 10 m/min., here 8 m/min. In fact, with certain yarns the rate $v_{F1}$ is very close to or equal to the rate $v_{F3}$. This type of operation is normally avoided as it slows production considerable.

It is also possible for the set-point generator 54 to be set at the factory and not be adjustable by the user, as the length of operation between levels 95 and 96 for this set-point generator 54 is relatively short.

In fact during this next-to-last phase of the cycle the support 12 is only given one reciprocation, that is one down and up motion until it reaches its uppermost point 71 at level 96. Thereupon the switch G is opened and the switch H from the programmed set-point generator 55 is closed. At the same time the switch C is closed to reverse-drive the shaft 27 by means of the motor 45. The result is a rapid dropping of the support 12 with concomitant slowing down to a complete stop from the relatively slow rate $v_{F3}$. Nonetheless the motor 15 continues to rotate somewhat although the speed it produces is extremely small relative to that of the motor 45. The ratio of time to speed for the programmable set-point generator 55 is set with respect to the speed at which the support 12 will be dropped by the motor 45 so that the support reaches the level 90 at the middle of the surface 57 a predetermined time $\Delta t$ before the motor 15 stops. Nonetheless the switch C for the motor 45 is opened when the support 12 reaches the level 90.

The result of this operation is that the filament 6 is wound several times about the region 57 in a plane perpendicular to the axis 8 at the level 90. According to this invention between 2.5 and 3.5 turns of the yarn 5 are wound around the region 57 at the end of the cycle during this time $\Delta t$. The rate-time program for generator 55 is the same for all types of yarn and does not need to be changed. Thus it can be set at the factory.

As mentioned above it is normally advantageous to make the last windings steeper in systems where the machine is unloaded by hand than in machines where it is unloaded automatically by machinery. This can easily be carried out by providing a two-position switch in conjunction with the programmed generator 55.

When the support 12 reaches its lowermost position at level 90 it rests on a support indicated at 18 in FIG. 1. Thus, even if the eccentric disk 17 overruns, the support 12 will not be moved into a position where it pulls the filament 6 off the region 57.

I claim:

1. In a yarn-winding method wherein a yarn-body core is supported on an upright spindle adjacent a vertically displaceable yarn guide, a yarn to be wound passes through said guide to said core, said core and spindle are rotated and simultaneously said guide is displaced upwardly along said core to wind said yarn on said core at a yarn-feed rate until an instant when a yarn package having a predetermined size is formed on said core, and thereafter said guide is lowered to a level below said core while said spindle continues to rotate to wind several turns of said yarn on said spindle below said core, the improvement comprising the steps of:

decreasing said yarn feed rate to a relatively low level prior to said instant; and regularly decreasing said yarn-feed rate to a standstill in accordance with a predetermined program starting at said instant and ending when said several turns have been wound on said spindle.

2. The method defined in claim 1 wherein said yarn guide is vertically reciprocated through strokes substantially shorter than the vertical height of said package during said upward displacement, said yarn-feed rate being decreased to said low level during the last single reciprocation prior to said instant.

3. The method defined in claim 2 wherein said yarn-feed rate prior to being decreased is between two and five times faster than said relatively low rate.

4. The method defined in claim 3 wherein said relatively low rotation rate is equal to between 6 m/min and 10 m/min.

5. The method defined in claim 1 wherein a plurality of such cores and spindles are rotated adjacent respective guides through which pass respective yarns, all of said spindles and cores and guides being displaced jointly.

6. The method defined in claim 1 wherein between 2.5 and 3.5 turns of said yarn are wound on said spindle prior to stopping of same.

7. The method defined in claim 1 wherein said yarn-feed rate is decreased linearly according to said program.

8. A yarn-winding apparatus comprising:

an upright spindle centered on and rotatable about an upright axis and adapted to support a yarn-body core;

a vertically displaceable yarn guide adjacent said spindle;

means for feeding a yarn to be wound through said guide to said core on said spindle;

primary drive means connected to said spindle and to said guide for simultaneously rotating said spindle and core about said axis at a relatively high rotation rate establishing a yarn-feed rate and for upwardly displacing said guide when a yarn package having a predetermined size is formed on said core;

secondary drive means for lowering said guide to a level below said core after said instant and while said spindle continues to rotate to wind several turns of said yarn on said spindle below said core; and control means connected to said primary and secondary drive means for decreasing said yarn-feed rate to a relatively low rate prior to said instant and for thereafter regularly decreasing said yarn-feed rate to a standstill in accordance with a predetermined program starting at said instant and ending when said several turns have been wound on said spindle.

9. The apparatus defined in claim 8 wherein said primary and secondary drive means include respective and separate primary and secondary drive motors.

10. The apparatus defined in claim 9 wherein said secondary drive motor is a reversible single-speed motor, said primary drive motor being a variable-speed motor.

11. The apparatus defined in claim 9 wherein said control means include switch means responsive to the axial position of said guide along said spindle and connected to said motors.

12. The apparatus defined in claim 9, further comprising a differential-type summing transmission having primary and secondary input gears respectively connected to said primary and secondary motors and an output gear connected to said yarn guide.

13. In a yarn-winding method wherein a yarn-body core is supported on an upright spindle adjacent a vertically displaceable yarn guide, a yarn to be wound passes through said guide to said core, said core and spindle are rotated and simultaneously said guide is displaced upwardly along said core to wind said yarn on said core at a yarn-feed rate until an instant when a yarn package having a predetermined size is formed on said core, and thereafter said guide is lowered to a level below said core while said spindle continues to rotate to wind several turns of said yarn on said spindle below said core, the improvement comprising the steps of:

decreasing said yarn feed rate to a relatively low level prior to said instant;

regularly decreasing said yarn-feed rate to a standstill in accordance with a predetermined program starting at said instant and ending when said several turns have been wound on said spindle; and displacing said guide at generally the same rate during decreasing of said yarn-feed rate.

* * * * *